US007775849B2

(12) United States Patent
Wong et al.

(10) Patent No.: US 7,775,849 B2
(45) Date of Patent: Aug. 17, 2010

(54) FENCING, SHOOTING AND SQUIRTING TOY

(76) Inventors: Veronica Pui Chung Wong, Suite 205, Kwong Sang Hong Ctr, 151 Hoi Bun Rd., Kwun Tong, Kowloon, Hong Kong (CN); Boguslau Orlowski, 120 Cristianitos Rd., Unit #142,08, San Clemente, CA (US) 92673

( * ) Notice: Subject to any disclaimer, the term of this patent is extended or adjusted under 35 U.S.C. 154(b) by 836 days.

(21) Appl. No.: 11/515,979

(22) Filed: Sep. 6, 2006

(65) Prior Publication Data

US 2007/0000942 A1 Jan. 4, 2007

Related U.S. Application Data

(63) Continuation-in-part of application No. 10/942,326, filed on Sep. 16, 2004, now Pat. No. 7,281,642, and a continuation-in-part of application No. 11/508,785, filed on Aug. 24, 2006, now abandoned.

(51) Int. Cl.
*A63H 23/12* (2006.01)
*A63H 33/30* (2006.01)

(52) U.S. Cl. ..... 446/153; 446/176; 446/473; 124/65

(58) Field of Classification Search ..... 446/153, 446/176, 267, 473; 222/78, 79; 124/65–67
See application file for complete search history.

(56) References Cited

U.S. PATENT DOCUMENTS

| | | | | |
|---|---|---|---|---|
| 213,050 | A | 3/1879 | Lewis | |
| D26,839 | S | 3/1897 | Lines | |
| 1,031,526 | A | 7/1912 | Cloud | |
| 1,394,456 | A | 10/1921 | Wanat | |
| D060,050 | S | 12/1921 | Mohler | |
| 2,573,375 | A | 10/1951 | Winstead | |
| 3,299,891 | A | 1/1967 | Smeton | |
| D225,755 | S | 1/1973 | Hale | |
| 3,884,229 | A | 5/1975 | Raines et al. | |
| 3,934,280 | A * | 1/1976 | Tancredi | 4/255.02 |
| D240,130 | S | 6/1976 | Folke | |
| 4,193,517 | A | 3/1980 | Fetty et al. | |
| 4,274,223 | A | 6/1981 | Morrison et al. | |

(Continued)

FOREIGN PATENT DOCUMENTS

| | | |
|---|---|---|
| GB | 2045097 | 10/1980 |

OTHER PUBLICATIONS

U.S. Appl. No. 29/302,703 filed Jan. 23, 2008.

(Continued)

*Primary Examiner*—Kien T Nguyen
(74) *Attorney, Agent, or Firm*—Amster, Rothstein & Ebenstein, LLP

(57) ABSTRACT

A toy fencing sword that is adapted to also fire its blade tip as a missile and to squirt water. The sword includes an internal piston activated by pulling and pushing the sword's handle to either fire the sword's tip as a missile or to inhale water and squirt it in a powerful stream. The sword is comprised of soft and buoyant materials which make it safe and painless during play and also make it ideally adapted for use in and around water, such as at a swimming pool.

24 Claims, 5 Drawing Sheets

U.S. PATENT DOCUMENTS

D262,079 S 12/1981 Rankin
4,383,387 A 5/1983 Puskar
4,548,190 A 10/1985 Megargee
4,597,527 A 7/1986 Sands
4,615,488 A 10/1986 Sands
4,627,796 A 12/1986 Moore
4,673,007 A 6/1987 Huang
4,733,799 A 3/1988 Wiskur
4,796,785 A 1/1989 Merritt
4,809,483 A 3/1989 Lovik
4,919,600 A 4/1990 Yang
4,963,847 A 10/1990 Cambreleng et al.
D315,095 S 3/1991 Wright
5,009,413 A 4/1991 Allen
D320,469 S 10/1991 Hoenig
5,061,252 A 10/1991 Dragosits
5,120,261 A 6/1992 Dietzman
D328,248 S 7/1992 Ruff
5,181,644 A 1/1993 Ferrell
5,199,114 A 4/1993 Christopher
D336,354 S 6/1993 Ringe
D336,668 S 6/1993 D'Andrade
D337,354 S 7/1993 Childs
5,224,633 A 7/1993 Senart
D338,697 S 8/1993 Salmon et al.
5,231,951 A 8/1993 Tagar et al.
D339,616 S 9/1993 Flaherty
5,255,708 A 10/1993 Liparoto et al.
5,256,099 A 10/1993 Rudell et al.
5,266,069 A 11/1993 Thorne
D344,311 S 2/1994 Liu
D344,556 S 2/1994 Liu
5,292,134 A * 3/1994 Schlundt et al. ..... 473/511
5,305,918 A 4/1994 D'Andrade
D351,007 S 9/1994 Bednar et al.
5,350,058 A 9/1994 Keough
D352,093 S 11/1994 Knycha
D354,093 S 1/1995 Hamlin
5,389,033 A 2/1995 Rauch
D357,886 S 5/1995 Fuller
D358,185 S 5/1995 Hope, II
D360,439 S 7/1995 Lewinski
D361,105 S 8/1995 Griffin
D362,801 S 10/1995 Milroy
D368,280 S 3/1996 Brown
5,499,858 A 3/1996 Her
5,667,419 A 9/1997 Spector
5,683,250 A 11/1997 Paivanas
5,788,617 A 8/1998 Paris
5,865,438 A 2/1999 Zilliox
5,928,053 A 7/1999 Henderson
5,988,442 A 11/1999 Corey et al.
5,992,697 A 11/1999 James
6,027,393 A 2/2000 O'Rourke
6,039,460 A 3/2000 Ng et al.
D424,932 S 5/2000 Seidler
D446,122 S 8/2001 Weinstein et al.
D449,982 S 11/2001 Ferris
6,474,858 B1 11/2002 Liao
6,568,985 B1 5/2003 Binkley
6,638,172 B1 10/2003 Demars
D470,761 S 11/2003 Kelvie
D481,770 S 11/2003 Choy
6,722,679 B2 4/2004 Englert
D494,856 S 8/2004 Hillard
6,790,112 B2 9/2004 Kirk
6,808,436 B1 10/2004 Siu
6,843,695 B1 1/2005 Jackson et al.
D514,633 S 2/2006 Zheng
6,997,770 B2 2/2006 Lapointe
D517,411 S 3/2006 Okimoto
7,025,228 B2 4/2006 Cuisinier
D524,881 S 7/2006 Orlowski et al.
D528,914 S 9/2006 Williams
D536,040 S 1/2007 Orr et al.
7,264,522 B2 9/2007 Lee et al.
7,281,642 B2 10/2007 Orlowski
D557,356 S 12/2007 Johnston et al.
D557,357 S 12/2007 Johnston et al.
D558,278 S 12/2007 Johnston et al.
D558,279 S 12/2007 Chen
D564,854 S 3/2008 Thompson
D570,687 S 6/2008 Kelders et al.
D574,443 S 8/2008 Wong
D590,027 S 4/2009 Chia
2003/0071077 A1 4/2003 Panzarella
2003/0124922 A1 7/2003 Sowry et al.
2003/0156590 A1 8/2003 Paul
2005/0106963 A1 5/2005 Ross
2005/0184098 A1 8/2005 Dixon
2005/0196287 A1 9/2005 Olich
2006/0027596 A1 2/2006 Walther et al.
2007/0000942 A1 1/2007 Wong et al.
2008/0035680 A1 2/2008 Orlowski
2008/0051002 A1 2/2008 Wong
2008/0054019 A1 3/2008 Stechschulte et al.
2008/0121652 A1 5/2008 Orlowski et al.

OTHER PUBLICATIONS

U.S. Appl. No. 29/302,709 filed Jan. 23, 2008.
*Prime Time Toys, Ltd.* v. *Jakks Pacific, Inc.*, No. 2008-CV-2909, document produced by Defendant Jakks Pacific, Inc. (Search Report, dated May 9, 2007).
*Prime Time Toys, Ltd.* v. *Jakks Pacific, Inc.*, No. 2008-CV-2909, document produced by Defendant Jakks Pacific, Inc. (UK Patent Application GB 2045097 A).

* cited by examiner

FENCING, SHOOTING AND SQUIRTING TOY

RELATED APPLICATION

This application is a continuation-in-part of both U.S. Letters Patent application Ser. No. 10/942,326 filed Sep. 16, 2004 now U.S. Pat. No. 7,281,642 and Ser. No. 11/508,785 filed Aug. 24, 2006 now abandoned, the specifications and drawings of which are incorporated herein in their entireties by reference.

FIELD OF THE INVENTION

The present invention is a fencing, shooting and squirting apparatus for use at play. More specifically, it is a soft foam-covered sword for use in play fencing and having a tubular air piston within the sword's blade for alternative use in firing the sword's soft foam tip as a projectile. Additionally, upon removal of the tip, the piston may be used to inhale and squirt water in a powerful blast. The materials and arrangement of the sword make it particularly well-adapted for use in and around water.

BACKGROUND AND OBJECTS OF THE INVENTION

Toy swords and other fencing toys are well known in many forms in the prior art. Numerous varieties of toys swords and other bladed battering toys, having soft blades and/or soft blade tips for safety are made and have been made over the years for use predominantly by children while play fencing or pretend battling.

Soft toy "swimming noodles" are also a very common and well-known prior art toy, used primarily in and around water, which are a simple homogenous tubular wand extruded of a resilient and buoyant closed-cell polymer foam, such as polyethylene foam, and which are often used by children for battering each other in pretend battling. The softness of these noodles eliminates the safety threat that they would otherwise pose. Said softness removes any hazard to those diving into the water, and the buoyancy of the foam makes the noodles float on water. The unique appearance of the foam material and the universal use of such noodles by children in and around water have created an instant recognition that promotes use of these noodles for play-battling without fear, as children have learned to instantly recognize that such noodles, and other toys made of the same material, are soft and not dangerous or painful. Children have also come to instantly, yet subconsciously, recognize that such noodles, and other things made of such materials are waterproof and buoyant, and so children have learned that they need not be overly cautious about using toys made of similar materials in and around water. So there is an inherent, yet non-obvious, benefit to leveraging the familiarity that these swimming noodles have developed by using such materials in other unrelated toys that might be used in and around water, to effectively promote their use in and around water.

U.S. Letters Patent application Ser. No. 10/942,326, of which the present application is a continuation-in-part, discloses a squirting toy which leverages the familiarity of the common swimming noodle by incorporating the same materials in a toy intended to be used in and around water.

Additionally, the prior art is filled with missile-shooting toys, such as toy guns, which use compressed air or the movement of a piston to eject and propel a soft foam missile. The use of a soft foam material eliminates the pain and hazard of being struck by such a missile, while the density and formability of components made of such a foam as that used in a swimming noodle allows for the manufacture of missiles that have sufficient flight and trajectory characteristics for play without danger.

It is an object of the present invention to provide an improved play-fencing sword that may also be used as a missile shooting toy; combining the benefits of play battering, missile-shooting, and water play into one toy in a non-obvious arrangement that not only disguises the intended next move of the combatants, but also subconsciously promotes the use of a shooting toy in and around water when such a type of toy has not previously been associated with water play, by leveraging the popularity and recognition of the swimming noodle.

The shape and configuration of the toy sword of the present invention disguises its missile-shooting capability. The arrangement of the missile-shooting mechanism enables the user to shoot the missile without substantially repositioning his/her hands from the fencing position to catch opponents by surprise. The sword's blade and its separable tip are made of a soft foam material, and the tip serves as the missile which may be instantly fired from the sword.

It is another object of the present invention to provide an improved play-fencing sword that may also be used as a water-squirting toy; combining the benefits of play battering, water-squirting, and water play into one toy in a non-obvious arrangement that not only disguises the intended next move of the combatants, but also subconsciously promotes the use of a squirting toy in and around water when such a type of toy has not previously been associated with water play, by leveraging the popularity and recognition of the swimming noodle.

The shape and configuration of the toy sword of the present invention disguises its squirting capability. The arrangement of the squirting mechanism enables the user to squirt water without substantially repositioning his/her hands from the fencing position to catch opponents by surprise. The sword's blade includes a hidden nozzle which enables water to be instantly ejected from the sword in a powerful and focused stream.

It is a further object to provide such a toy that is both buoyant and soft for use in and around water, and that the soft and buoyant material used to make several of the components of the toy are readily associated with use in and around water, where play swords and missile-shooting toys are not commonly used due to the incompatibility of most prior art play swords and missile shooters with water, and the inherent dangers of such use in the past.

The present invention subliminally, but non-obviously, simulates certain aspects of the appearance of a familiar "swimming noodle", so that children will readily recognize that the sword blade and blade tip are soft and will not fear being hit by them, and which promotes its use in and around and its association with water, thereby creating a new marketplace for play swords and missile shooting toys, while providing the additional benefit of water-squirting.

Further objects and advantages of the invention will be apparent upon a review of the following description and drawings of the invention, including the preferred embodiment thereof.

SUMMARY OF THE INVENTION

The present invention comprises a toy fencing sword that is adapted to also fire its blade tip as a missile and to squirt water in a powerful and focused steam. The sword is comprised of soft and buoyant materials which make it safe and painless during play and also make it ideally adapted for use in and around water, such as at a swimming pool. The blade of the sword, including its launchable tip, are made primarily of polyethylene (PE) closed cell foam. This closed cell material is non-absorbing and less dense than water, so that the blade tip and/or the whole sword will remain buoyant if they fall into the water, and the foam is soft, so that the sword and its tip will not cause harm or pain during use and so that swimmers accidentally diving into the water and landing on a sword or tip floating on the water surface will not be injured.

In the preferred embodiment, the sword is comprised of a cylindrical housing and a piston hidden within the soft foam outer surfaces of the blade. The piston slides within the housing to pull air into the housing or to force it out via a hole near to the blade's tip end. The air enters through the sword's handle end during the expansion stroke of the piston by the user, who causes such expansion by simply retracting the swords handle from its blade. That air then exits in a blast though the opposite "tip" end during the opposite compression stroke of the piston, thereby pneumatically forcing the blade tip from the sword as a missile.

Alternatively, with the blade tip removed, the forward end of the remaining portion of the blade may be placed into water and the piston can then be used to pull that water into the housing during that expansion stroke and to force it out via that same hole in a powerful stream during the compression stroke.

The foam covering of the major components of preferred embodiment is similar in appearance and feel to a common "swimming noodle", and is therefore more attractive to and well-recognized by a typical child who is familiar with such noodles and therefore immediately understands the toy to be soft, acceptable for battering, and water tolerant.

The material and color matching of the blade to its tip serve to disguise the fact that the sword is also capable of squirting and missile-firing, and the shape and arrangement of the components provide the ability to actuate the firing of the missile or squirting quickly from the normal holding position used during fencing, which further enhances the surprise capability of the missile firing function.

A more complete understanding of the invention will be realized upon review of the following description of the preferred embodiment of the invention and the appended drawings.

DETAILED DESCRIPTION OF THE PREFERRED EMBODIMENT

Figure 1:
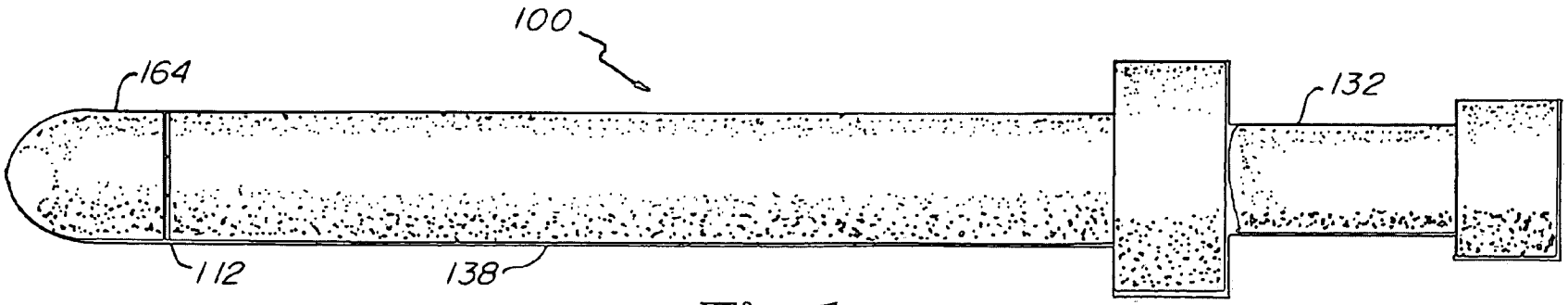
FIG. 1 is a side view of a toy fencing sword according to the preferred embodiment of the invention.
Figure 2:
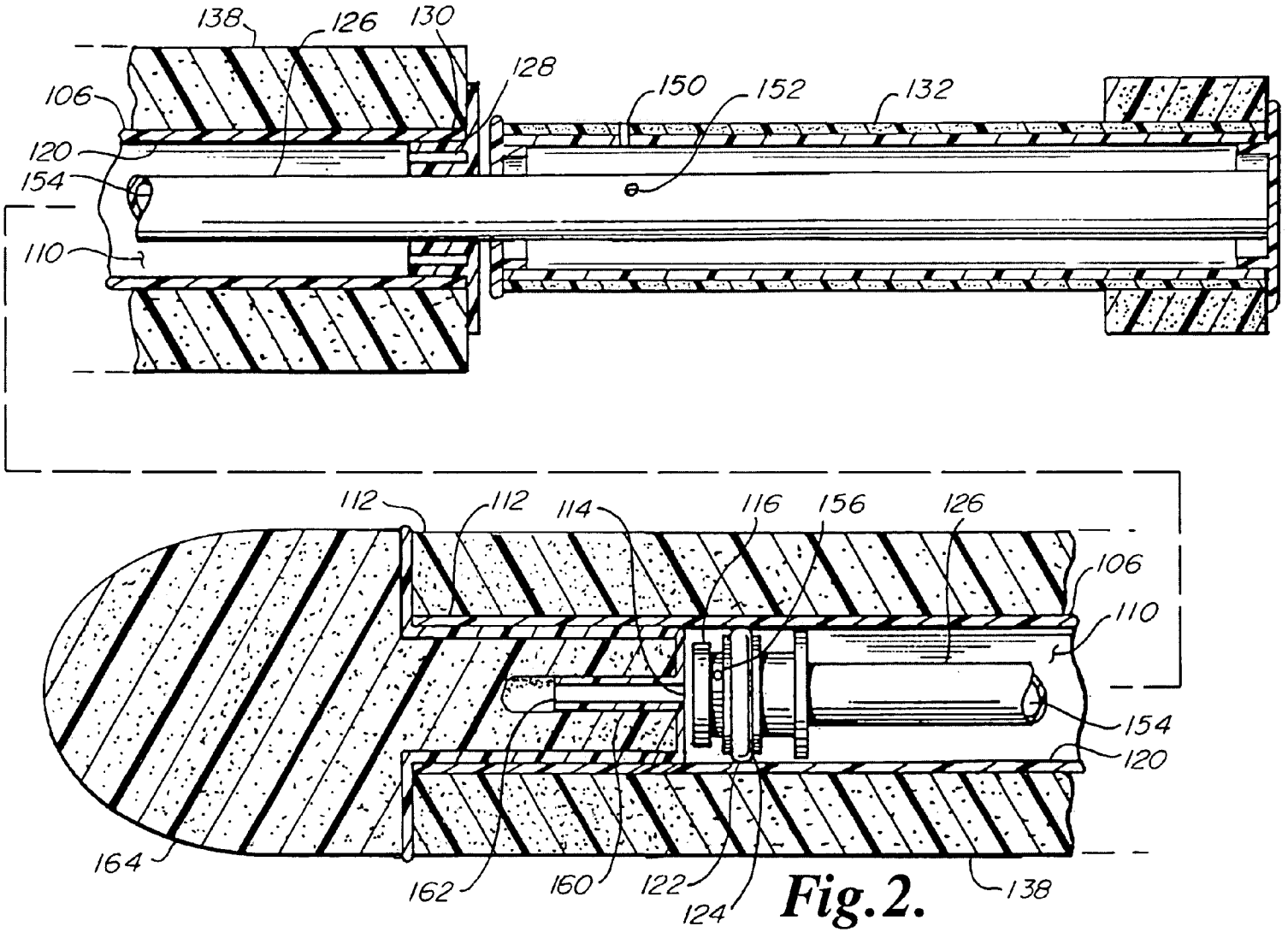
FIG. 2 is a cross-sectional view through the toy of FIG. 1 in its compressed and normal fencing state.

The preferred embodiment of the invention is shown in FIGS. 1 though 6, where there is depicted a toy 100 for fencing, water-squirting or missile-shooting.

The toy comprises a rigid tubular housing 106 that encloses a hollow cylindrical chamber 110. The forward end 112 of the tubular housing is closed except for a small hole 114. Piston 116 slides longitudinally within chamber 110 and is sealed against the cylindrical inner surface 120 of the chamber by o-ring 122, which is seated within groove 124 of the piston. The piston separates the chamber 110 into a forward portion 110A and a rear portion 110B.

The piston 116 is rigidly connected to shaft 126 at the forward end thereof. Slide bushing 128 supports shaft 126 at the rear end 130 of the tubular housing 106, while allowing longitudinal movement relative thereto. Handle portion 132 is rigidly connected to shaft 126 at the rearward end thereof.

Figure 4:
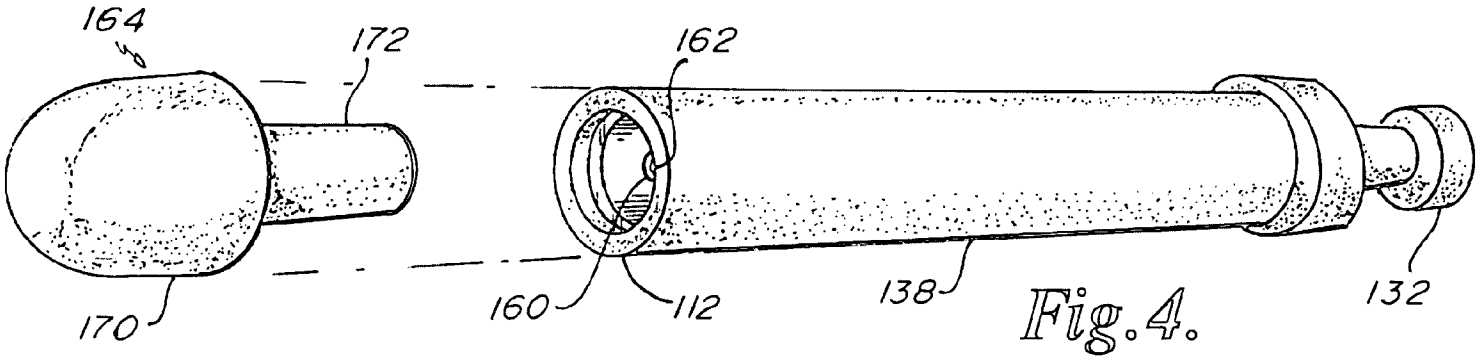
FIG. 4 is a perspective view showing the firing of the sword's blade tip as a missile from the sword just after the completion of the compression stroke of FIG. 3B.
Figure 3A:
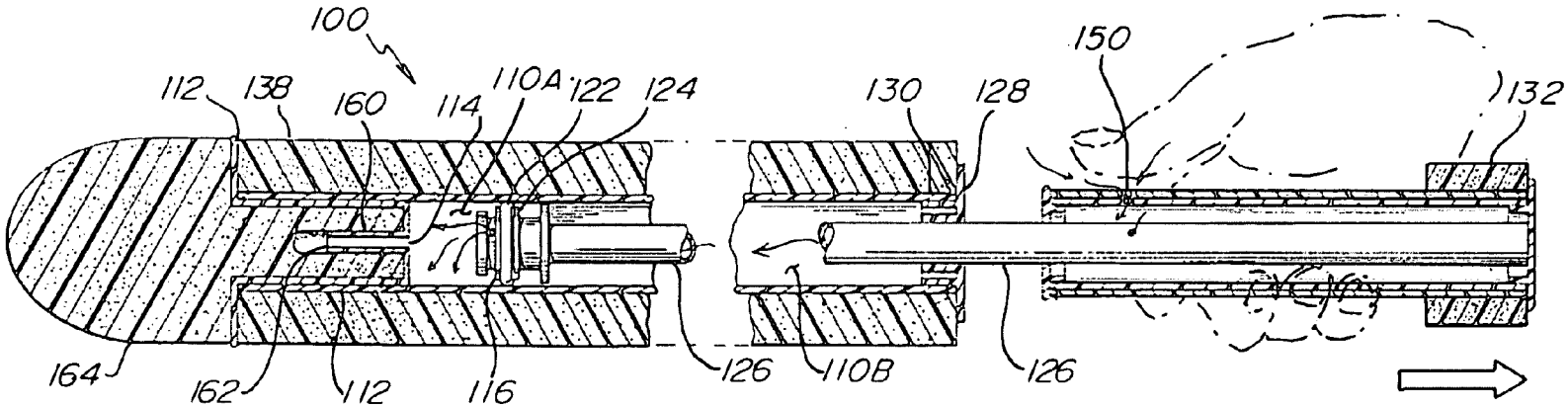
FIG. 3A is a cross-sectional view through the toy of FIG. 1 during expansion of its piston from its compressed fencing state to its expanded state, for missile-firing.
Figure 3B:
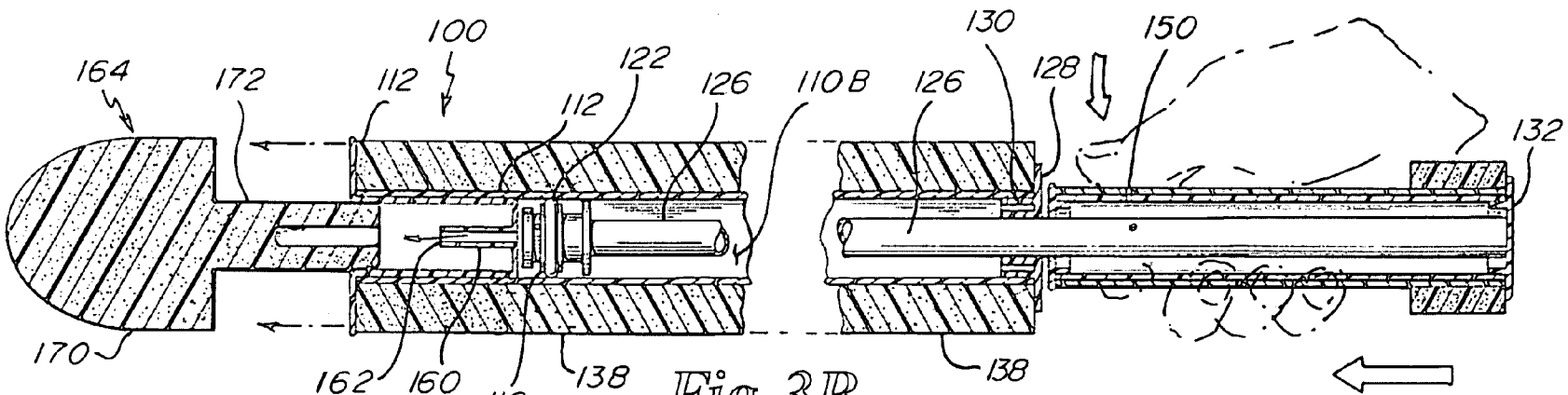
FIG. 3B is a cross-sectional view through the toy of FIG. 3A during compression of its piston from its expanded state back to its compressed fencing state. showing the expulsion of the sword's blade tip as a missile.

Use of the sword for missile firing is shown in FIGS. 3A, 3B and 4 and will now be described with reference thereto.

Expansion of the handle portion 132 relative to the tubular housing 106, as shown in FIG. 3A, causes air to be inhaled into the expanding forward chamber portion 110A, through holes 150 and 152 in handle portion 132, through the hollow interior 154 of shaft 126, and then through hole 156 of piston 116. Less preferably, intake holes could be positioned elsewhere to allow air to enter the expanding forward chamber portion during the expansion stroke of piston 116, such as through housing 106 or through slide bushing 128 and piston 116.

Subsequent rapid compression of the handle portion 132 relative to the tubular housing 106, as shown in FIG. 3B causes that air to be exhaled through hole 114 in a powerful blast.

Hollow missile mounting post 160 is disposed at and in pneumatic communication with hole 114, such that air being so blasted from forward chamber portion 110A is directed though the mounting post and exits through its exhaust hole 162.

Tubular sword blade 138, preferably made of closed-cell polyethylene foam, surrounds tubular housing 106, to serve as the blade of the sword during fencing, and to also provide both a soft harmless surface and buoyancy. Other materials may be substituted for polyethylene foam, such as ethylene vinyl acetate closed-cell foam, closed cell neoprene, or numerous similarly soft and buoyant materials.

Soft blade tip 164 is disposed at the forward end 112 of blade 138 during fencing use, such as shown in FIG. 1. Tip 164 includes missile-shaped body 170 and hollow shaft 172. Hollow shaft 172 is shaped and arranged to fit snuggly but removably within the forward end of blade 138 and to fit over mounting post 160. Tip 164 is sufficiently snuggly mounted within the forward end of the blade so that it does not inadvertently slip from the blade during fencing.

Tip 164 is preferably made of the same material as blade 138. Its color is preferably the same as that of blade 138 so that at casual glance, the tip is disguised to be an integral part of the blade and sword.

It should be readily appreciated that the afore-described blast of air which is expelled from exhaust hole 162 during the rapid compression of handle portion 132 will cause the rapid expulsion of tip 164 from blade 138 in missile-like fashion, as shown in FIG. 4.

It should also be appreciated that some of the air in forward chamber portion 110A may escape the chamber during the compression stroke by way of holes 156, 152 and 150, thereby reducing the ejection force of the air existing through hole 162. Although may appear to be a flaw in the design at first glance, but is actually a significant benefit to the design.

Because hole 150 is positioned on handle portion 132 at the position where a user would normal place his/her thumb when grasping the sword, it is simple for the user to instantly select between a lower or a higher ejection speed during missile firing, By simply blocking hole 150 with the thumb during the compression stroke, the exhaustion of air through hole 150 is denied and all exhausted air is forced through hole 162, and the user can thereby create more high-speed ejection, shooting the missile further and faster than when the hole is not blocked. This convenient and instantly selectable "two speed" missile firing capability is a unique and significant aspect of the invention. Even when a target player becomes aware that the sword holder is about to fire a missile, it is virtually impossible to recognized whether the missile will be shot at high or low speed, thereby furthering the surprise effect of the missile.

Because body 170 of tip 164 is missile-shaped and because, through the much greater mass of body 174 than shaft 172, the center-of-mass of tip 164 is substantially the same as the center-of-mass of body 170, tip 164 is especially well-adapted for missile-like flight, with hollow shaft 172 serving basically as a stabilizing tail during flight. During propulsion of tip 164 through the air, this arrangement causes the tip to maintain a stabile and straight course, without tumbling or erratic movement.

One can also readily appreciate that by use of the sword's handle portion 132 to actuate the propulsion of tip 164, and the disguising of the tip as an integral part of the blade 138, it allows the user to surprise opponents who may not be aware of the missile-firing function of sword 100. In fact, one using the sword in its typical fencing mode and thereby grasping it by handle portion 132 needs only to quickly grasp blade 138 with his/her other hand, and quickly draw back and forth on handle portion 132 with the hand already grasping it, while aiming the sword at the opponent, to fire an unexpected missile. Coupling this with the two-speed missile firing capability that is nearly impossible to pre-detect, the invention allows the user a plurality of surprising options while battling against his/her foes.

Additionally, because tip 164 is preferably made of soft and buoyant closed-cell foam, it will float retrievably on the water surface and will not pose a safety hazard to others diving into the water if it should inadvertently alight on the surface of the water after firing. And the foam material used in the blade and blade tip are preferably identical to those used in swimming noodles, so that children are generally familiar to the fact that this toy is suited for use in and around water just by its general appearance. These factors, and other, make the missile-firing sword particularly well adapted for use in and around water.

Figures 5A, 5B:
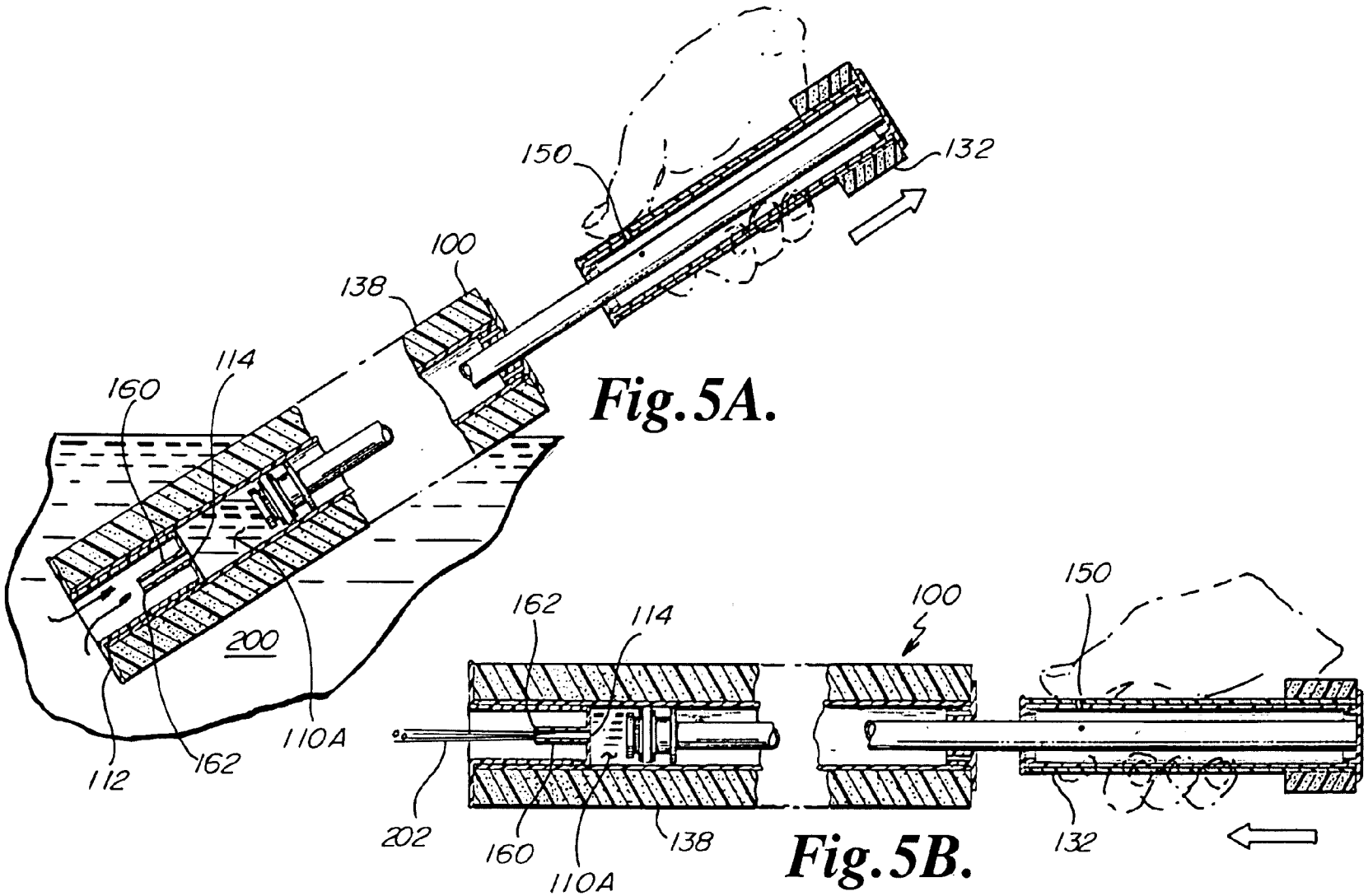
FIG. 5A is a cross-sectional view through the toy of FIG. 1 with its forward end submerged in water, and during expansion of its piston from its compressed fencing state to its expanded state, for water-squirting.
FIG. 5B is a cross-sectional view through the toy of FIG. 5A during compression of its piston from its expanded state back to its compressed fencing state, showing the squirting of water from the nozzle.
Figure 6:
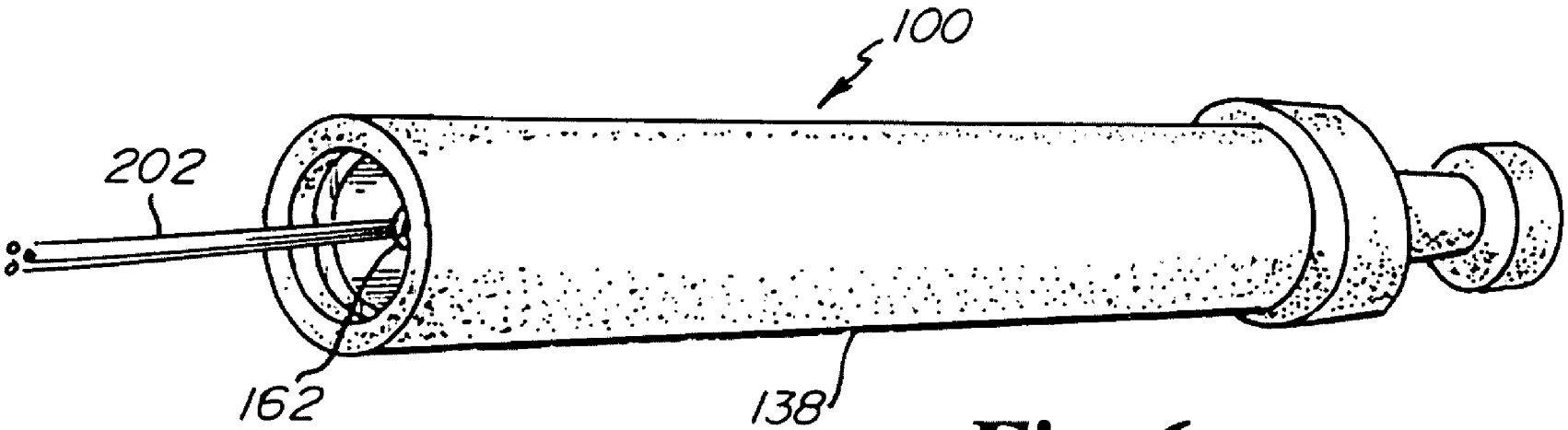
FIG. 6 is a perspective view showing the squirting of water from the sword just after the completion of the compression stroke of FIG. 5B.

Use of the sword for water squirting is shown in FIGS. 5A, 5B and 6, and will now be described with reference thereto, with tip 164 having been removed either manually or by missile-firing.

Forward end 112 is submerged into water 200, such as in a swimming pool, with exhaust hole 162 below the water's surface. Hole 150 is blocked by the user's thumb during use of the toy for water squirting. Handle portion 132 is retracted in an identical motion as described above for missile-firing, except that in this case, water is inhaled into the forward chamber portion 110A, as shown in FIG. 5A. Because hole 150 is blocked, no air is inhaled into the chamber.

With the toy next aimed at an opponent, handle portion 132 is pushed rapidly forwardly in a motion identical to that described above for missile-firing and, because hole 150 remains blocked, all of the water in chamber portion 110A is forced in a rapid burst through hole 114, post 160, and is ejected from the toy in a powerful and focused stream 202 through exhaust hole 162.

It will be appreciated by those skilled in the applicable arts that the foregoing is merely one of many possible embodiments of the invention, and that the invention should therefore only be limited according to the following claims.

We claim:

1. A fencing, squirting and missile-shooting toy, comprising:

a sword-shaped body having axially aligned elongate handle and elongate blade portions, said sword-shaped body adapted for play fencing by holding said toy by said handle portion while battering and poking opponents with said blade portion;

said blade portion having a forward terminal end disposed opposite from said handle portion and comprising a hollow rigid elongate tubular housing adapted to receive a piston slidably there-within;

said housing comprising an air exhaust opening adjacent to said forward terminal end of said blade portion;

said piston comprising a slidable seal adapted to movably and sealingly engage the inner surface of said tubular housing such that said piston is sealingly movable longitudinally within said housing to thereby define an expandable and contractible air chamber within said housing between said piston and said air exhaust opening;

an air intake opening adapted to allow air to enter said expandable air chamber as said piston is moved longitudinally away from said forward terminal end;

said blade portion further comprising a soft and buoyant foam outer shell;

said blade portion further comprising a soft and buoyant tip portion adjacent to and removable from said forward terminal end;

said handle portion being longitudinally movable relative to said blade portion and rigidly connected to said piston such that moving said handle portion longitudinally relative to said blade portion causes said piston to move longitudinally within said housing;

wherein, pulling said handle portion longitudinally away from said first terminal end causes air to enter said expandable air chamber through said air intake opening; and subsequently pushing said handle portion longitudinally towards said first terminal end portion causes said intaken air to be exhausted from said expandable air chamber through said air exhaust opening and to thereby expel said tip portion from said forward terminal end as a missile which flies in substantially the same direction as the handle portion is pushed;

wherein, upon removal of said tip portion from said forward terminal end, submersion of said air exhaust opening into water, and blocking of said air intake opening, said air exhaust opening becomes a water intake and exhaust opening and said expandable air chamber becomes an expandable water chamber, and pulling said handle portion longitudinally away from said first terminal end causes water to enter said expandable water chamber through said water intake and exhaust opening; and subsequently pushing said handle portion longitudinally towards said first terminal end portion causes said intaken water to be exhausted from said expandable water chamber through said water intake and exhaust opening and to thereby be expelled from said forward terminal end as water stream which flies in substantially the same direction as the handle portion is pushed; and wherein said tip is tapered narrower from said forward terminal end of said blade portion.

2. The toy of claim 1 wherein said handle and tip are comprised of a soft and buoyant foam material.

3. The toy of claim 2 wherein said soft and buoyant foam material is a closed-cell foam.

4. The toy of claim 3 wherein said closed-cell foam is taken from one of polyethylene foam, polypropylene foam, ethylene vinyl acetate foam, or neoprene foam.

5. The toy of claim 1 wherein said an air intake opening comprises an air intake channel communicating between the outside environment and said expandable air chamber through said handle portion and disposed such that a user may selectively block said channel while pushing said handle portion longitudinally towards said first terminal end portion to selectively deny said intaken air from being exhausted from said expandable air chamber through said air intake channel.

6. The toy of claim 5 wherein said handle and tip are comprised of a soft and buoyant foam material.

7. The toy of claim 6 wherein said soft and buoyant foam material is a closed-cell foam.

8. The toy of claim 7 wherein said closed-cell foam is taken from one of polyethylene foam, polypropylene foam, ethylene vinyl acetate foam, or neoprene foam.

9. A toy sword adapted for play fencing, comprising:

a handle and an elongate blade, said handle being longitudinally movable relative to said blade and comprising a piston which is slidable within an elongate cylindrical chamber of said blade to form an air chamber, said air chamber being expanded during an expansion stroke of said piston and being compressed during a compression stroke of said piston, said air chamber having an air outlet having a cross-sectional area that is smaller than the cross-sectional area of said cylindrical chamber to allow the rapid exhaustion of air there-through from said air chamber during said compression stroke, said blade further comprising a removable tip disposed longitudinally transverse from said handle and adjacent to and in communication with said air outlet such that air exiting said air chamber through said compression stroke forces said tip from said blade as a projectile; and wherein, upon removal of said tip from said toy sword and submersion of said air outlet into water, said air outlet becomes a water inlet and outlet and said air chamber becomes a water chamber, said water chamber being expanded during an expansion stroke of said piston and being compressed during a compression stroke of said piston, said water inlet and outlet having a cross-sectional area that is smaller than the cross-sectional area of said cylindrical chamber to allow the rapid expulsion of water there-through from said water chamber during said compression stroke.

10. The toy sword of claim 9 wherein said tip is comprised of a first soft foam material.

11. The toy of claim 10 wherein said blade is comprised of a second soft foam material.

12. The toy of claim 11 wherein said first soft foam material and said second soft foam material are of the same color.

13. The toy sword of claim 9 wherein said outlet increases the pressure in the chamber during the compression stroke such that at least one of water and air accelerates through the outlet causing a rapid expulsion of at least one of water and air.

14. The toy of claim 9 wherein at least one of said handle and tip are comprised of a soft and buoyant foam material.

15. The toy of claim 14 wherein said soft and buoyant foam material is a closed-cell foam.

16. The toy of claim 15 wherein said closed-cell foam is taken from one of polyethylene foam, polypropylene foam, ethylene vinyl acetate foam, or neoprene foam.

17. A squirting toy sword adapted for play fencing comprising:

a handle and an elongate blade that is substantially covered with a foam outer shell that provides safety benefits, said handle being longitudinally movable relative to said blade and comprising a piston which is slidable within an elongate cylindrical chamber of said blade to form an air chamber, said air chamber being expanded during an expansion stroke of said piston and being compressed during a compression stroke of said piston; and an air outlet adapted to allow the rapid exhaustion of air from said air chamber during said compression stroke, said air outlet having a diameter smaller than the diameter of said cylindrical chamber, wherein, upon submersion of said air outlet into water, said air outlet becomes a water inlet and outlet having a diameter smaller than the diameter of said cylindrical chamber and said air chamber becomes a water chamber, said water chamber being expanded during an expansion stroke of said piston and being compressed during a compression stroke of said piston, said water inlet and outlet being adapted to allow the expulsion of water in a powerful stream from said water chamber during said compression stroke.

18. The toy of claim 17 wherein said soft and buoyant foam material is a closed-cell foam.

19. The toy of claim 18 wherein said closed-cell foam is taken from one of polyethylene foam, polypropylene foam, ethylene vinyl acetate foam, or neoprene foam.

20. The toy of claim 17, wherein said blade of said squirting toy is further comprising a removable tip disposed longitudinally transverse from said handle and adjacent to and in communication with said air outlet such that air exiting said air chamber through said compression stroke forces said tip from said blade as a projectile.

21. A toy sword adapted for play fencing, comprising:

a handle and an elongate blade, said handle being longitudinally movable relative to said blade and comprising a piston which is slidable within an elongate cylindrical chamber of said blade to form an air chamber, said air chamber being expanded during an expansion stroke of said piston and being compressed during a compression stroke of said piston, said air chamber having an air outlet adapted to allow the rapid exhaustion of air there-through from said air chamber during said compression stroke, said blade further comprising a removable tip disposed longitudinally transverse from said handle and adjacent to and in communication with said air outlet such that air exiting said air chamber through said compression stroke forces said tip from said blade as a projectile;

wherein, upon removal of said tip from said toy sword and submersion of said air outlet into water, said air outlet becomes a water inlet and outlet and said air chamber becomes a water chamber, said water chamber being expanded during an expansion stroke of said piston and being compressed during a compression stroke of said piston, said water inlet and outlet being adapted to allow the rapid expulsion of water there-through from said water chamber during said compression stroke; and wherein said tip is tapered narrower from said forward terminal end of said blade portion.

22. The toy of claim 21 wherein at least one of said handle and tip are comprised of a soft and buoyant foam material.

23. The toy of claim 22 wherein said soft and buoyant foam material is a closed-cell foam.

24. The toy of claim 23 wherein said closed-cell foam is taken from one of polyethylene foam, polypropylene foam, ethylene vinyl acetate foam, or neoprene foam.

* * * * *